US005599021A

United States Patent [19]

Lary et al.

[11] Patent Number: 5,599,021

[45] Date of Patent: Feb. 4, 1997

[54] GOLF SWING MUSCLE ARTICULATOR AND REHABILITATION DEVICE

[76] Inventors: Banning K. Lary, 10100 Rocking Horse Rd., Austin, Tex. 78748; William M. Stevens, 9717 Oak Hollow Dr., Austin, Tex. 78758

[21] Appl. No.: 436,654

[22] Filed: May 8, 1995

[51] Int. Cl.[6] ..... A63B 69/36

[52] U.S. Cl. ..... 473/219; 482/92; 473/232; 473/242; 473/520; 473/558

[58] Field of Search ..... 273/26 B, 193 R, 273/193 A, 193 B, 194 R, 194 A, 194 B, 186.7; 482/92, 93, 109, 110, 121, 131, 94

[56] References Cited

U.S. PATENT DOCUMENTS

| | | | |
|---|---|---|---|
| 48,050 | 6/1885 | Butler | 482/94 |
| 3,428,325 | 2/1969 | Atkinson | 273/186.2 |
| 3,722,890 | 3/1973 | Wiebolt | 273/186.2 |
| 3,743,297 | 7/1973 | Dennis | 273/193 A |
| 4,213,614 | 7/1980 | Philippi | 273/194 B |
| 4,444,396 | 4/1984 | Wendt | 273/193 A |
| 4,555,111 | 11/1985 | Alvarez | 273/26 B |
| 4,602,788 | 7/1986 | Wendt | 273/193 A |
| 4,809,975 | 3/1989 | Lee | 273/193 A X |
| 4,969,921 | 11/1990 | Silvera | 273/186.2 |
| 5,002,275 | 3/1991 | Buetler et al. | 273/193 A X |
| 5,026,064 | 6/1991 | Novosel | 273/186.5 |
| 5,040,788 | 8/1991 | Randall | 273/193 A X |
| 5,121,925 | 6/1992 | Blundo | 273/193 A |
| 5,209,481 | 5/1993 | De Back | 273/186.2 |
| 5,236,192 | 8/1993 | Pitzel | 273/186.2 |
| 5,249,803 | 10/1993 | Giffin | 273/193 A |
| 5,306,010 | 4/1994 | Choi | 273/186.2 |
| 5,330,190 | 7/1994 | Oakley, Jr. | 273/186.2 |
| 5,330,193 | 7/1994 | Ijiri | 273/193 A |
| 5,405,138 | 4/1995 | Duran | 273/186.2 |
| 5,405,139 | 4/1995 | Gagarin | 273/186.2 |

*Primary Examiner*—William H. Grieb

[57] ABSTRACT

A sports swing exercise device composed of a weight attached to a shaft by means of a spring. When the shaft is swung, the muscles used in the swing are not only strengthened with repeat use, they are stretched toward full articulation with the spring as it eases the transition of momentum and inertia at the ends of the swing from one direction to its opposite.

2 Claims, 2 Drawing Sheets

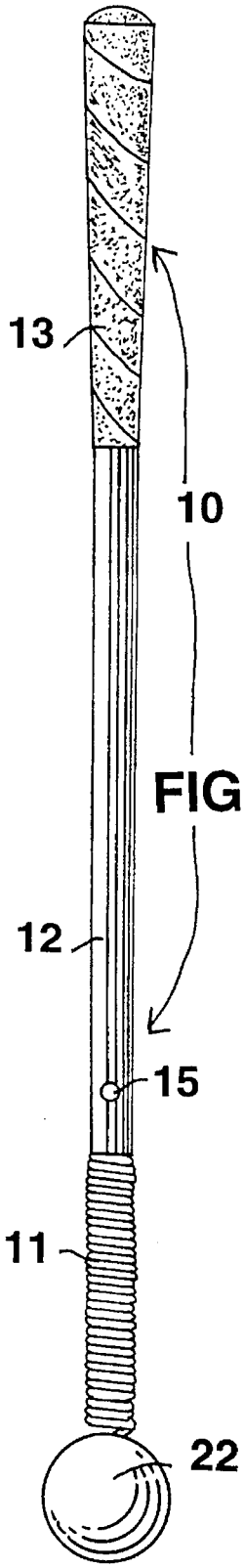
FIG. 1
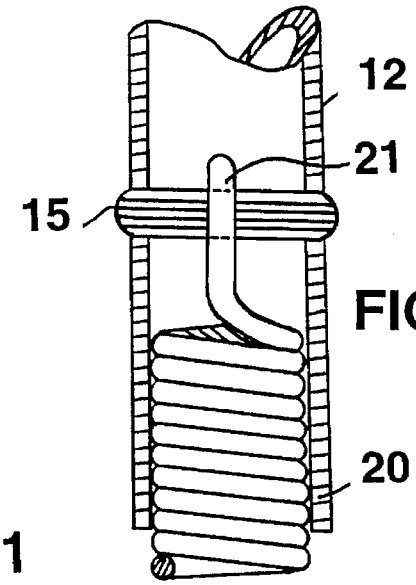
FIG. 3B
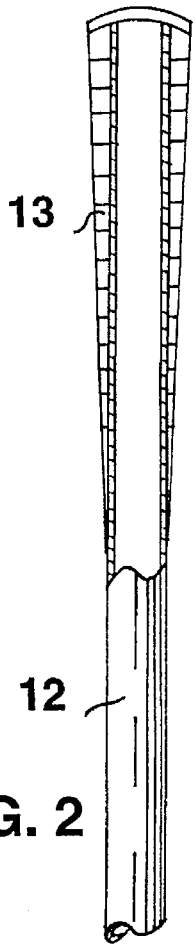
FIG. 2
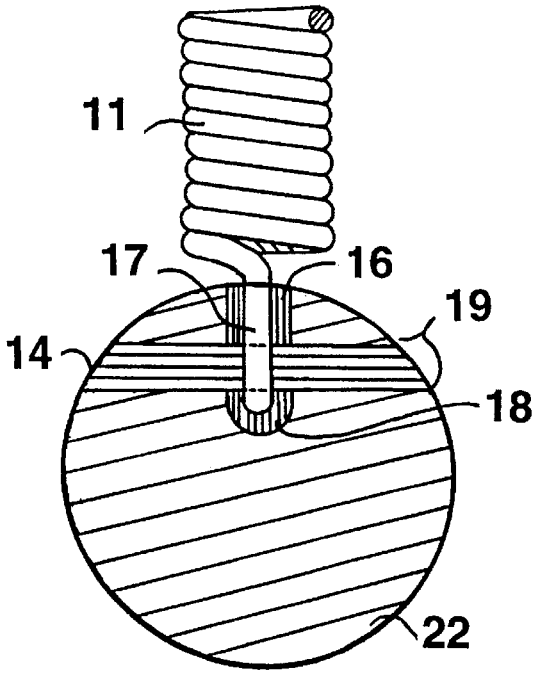
FIG. 3A
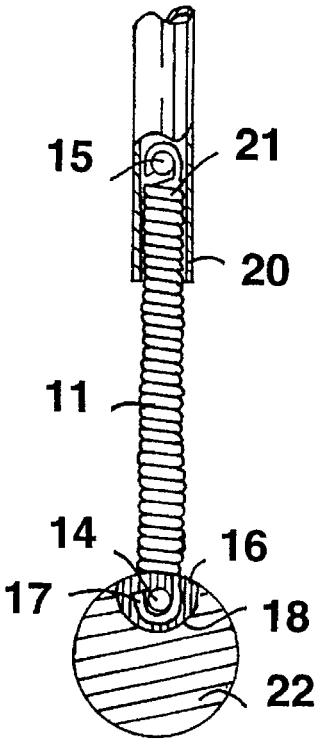

GOLF SWING MUSCLE ARTICULATOR AND REHABILITATION DEVICE

BACKGROUND

1. Field of Invention

This invention relates to weighted shafts used for exercising, strengthening and stretching muscles, so as to develop muscular memory and physical expertise at sports such as golf, tennis, baseball and others, while minimizing the shock and stress imposed on the muscles at the end of the swing.

2. Description of Prior Art

The idea of using isotonic and isometric resistance in the development of training regiments to help foster superior performance at games has been the goal of athletes and coaches for centuries.

Weighted shafts of various configurations have been devised by others to exercise and strengthen muscles by swinging them back and forth along a path similar to that a golf club, tennis racket, baseball bat and so forth. It has been demonstrated that by adding weight to the swing path during training, muscle performance is enhanced.

A search of the patent literature has revealed a number of sports swing exercise devices reaching back to U.S. Pat. No. 48,050 by Butler issued in June 1865. More current and thus more applicable patents, some employing as a key feature a weight swung on the end of a shaft, are as follows.

U.S. Pat. No. 3,743,297 (1973) involves an end-weighted shaft for golf swing practice whereby a ball is designed to "accommodate unsuitable and removable weights."

U.S. Pat. No. 4,213,614 (1980) involves a "combination weight attachment and golf club cover" whereby "lead pellets or other weighted materials are enclosed in the zippered bag to provide means for adjusting the attached weight to individual taste."

U.S. Pat. Nos. 4,444,396 (1984) and 4,602,788 (1986) by Wendt involve a shaft that is end-fitted to accept a "series of perforated discs weighing 1,2,4,8 and 16 ounces" whereby the user can weight the shaft according to his desired training resistance.

U.S. Pat. No. 5,209,481 (1993) employs a golf handle within a curved or L shaped member whereby an adjustable weight is attached to the lower arc and swung.

U.S. Pat. No. 5,121,925 (1992) is comprised of a weight at the end of a shaft with the end "thereof bent at about 22.05 degrees and on which rotatable off-center swing weights are mounted which enables a user to simulate the movements of a proper golf swing and which also exercises the muscles of a golfer making such a swing."

U.S. Pat. No. 5,249,803 (1993) involves a "shaft having a grip end and a head end, a weight disposed at the head end, and a link nonintegrally attaching the weight to the head end of the shaft."

U.S. Pat. No. 5,330,193 (1994) is for a device with a symmetrical end-weighted tapering shaft where the weights are "cylindrical members of different sizes."

U.S. Pat. No. 5,330,190 (1994) is another end-weighted golf trainer employing two tubes of polyvinylchloride that provide "limited resilience and flexibility."

In addition to end-weighted swing training devices, others using wind resistance in lieu of weights to increase the training effect have been invented, notably U.S. Pat. Nos. 5,002,275 (1991), 5,026,064 (1991) and 5,236,192 (1993).

U.S. Pat. No. 5,040,788 (1991) employs a stretchable cord the user attaches to a doorknob. U.S. Pat. No. 3,722,890 (1973) deals with a loop attached to a threaded eye bolt with a pair of lock nuts "between which a plurality of washers are clamped" and fits over a golf club head.

Two other patents that approximate a key feature of our design, but that do not use it in the manner later discussed, are U.S. Pat. No. 4,809,975 (1989) that employs an end weight that slides outward against a spring on a shaft when swung, and U.S. Pat. No. 4,969,921 (1990) whereby a weight slides outward against a spring inside a hollow shaft. Both of these inventions use a coiled compression spring to cushion the weight as it slides outward due to the centifugal force manufactured by the swing.

While all of the above inventions, and others of an ancillary nature not discussed herein, do assist in exercising and conditioning a user's muscles along the swing path, they are all deficient in addressing one important aspect when compared to our present invention, namely the abrupt shock and stress imposed on the muscles at the end of the swing where the fullest articulation occurs.

Full articulation is an important and, desirable aspect of a sports swing for several reasons:

First, full and safe articulation of muscles during a sports swing enables the athlete to maximize the inherent natural capability of his or her physiological body design resulting in optimum performance.

Second, if a sports device can be swung a further distance, the momentum of the device will be increased, thus enabling the device to propel an object a greater distance.

Thirdly, by distributing the effects of the sports swing over a fuller range of muscle movement through stretching, the chance for injury to any particular muscle or muscle group is reduced.

The benefits of adequate stretching before and after athletic competition are well-documented in popular and professional literature, as per these and other references:

1. "Flex Time—Once Ignored, flexibility is now considered essential to fitness," *AMERICAN HEALTH,* April 1993, Pgs. 68–73.
2. "Treating and Preventing Little League Elbow," *THE PHYSICIAN AND SPORTS MEDICINE,* March 1994, Pgs. 54–66.
3. "Ahead of the Game—Best-ever workout tips, Tactics and equipment for the weekend athlete," *MEN'S HEALTH,* April 1994, Pgs. 44–49.
4. "Flexibility—Bend to Get Big," *MUSCLE & FITNESS,* June 1994, Pgs. 99–101.
5. "Full Back Stretches Relieve Pain," *MUSCLE & FITNESS,* October 1994, Pgs. 250–252.

OBJECTS AND ADVANTAGES

The primary object of the present invention is to promote the fullest safest articulation possible of the muscles during the sports swing while building strength and endurance in a manner compatible with the least possible risk of injury. This is accomplished through the unique design of separating the weight from the shaft by means of a flexible flat or coiled spring. Several advantages of the present invention are:

(a) to provide a device that can stretch the muscles before and after competition that will gently and gradually ease them into a posture of the fullest desirable articulation.

(b) to provide a completely portable device that can be used away from the sports field of play to strengthen and condition muscles at any time the athlete may desire.

(c) to provide a device that may be used for rehabilitation of muscles after an injury.

(d) to provide a device that may be used to loosen, strengthen or condition any or all parts of a sports swing, i.e. wrists, arms, back, torso, waist and so forth, by minimizing stress and strain imposed by the centrifugal force and momentum generated by the swing such is accomplished by a spring attached between the shaft and the weight.

Further objects and advantages are to, provide a device that can be used by athletes of any age and of any level of expertise to increase power, strength, stamina and range of motion during the sports swing. Further advantages of our invention will become apparent from a consideration of the drawings and ensuing description.

DRAWINGS FIGURES (BRIEF DESCRIPTION OF DRAWINGS)

In the drawings, closely related figures have the same number but different alphabetic suffixes.

FIG. 1 illustrates the sports swing exercise device constructed according to the principles of the present invention.

FIG. 2 is a broken view, partially in cross-section, of the sports swing exercise device as taken along the lines of FIG. 1.

FIG. 3A is a longitudinal cross-section of the weight/spring attachment and FIG. 3B is a longitudinal cross-section of the shaft/spring attachment.

Figure 4:
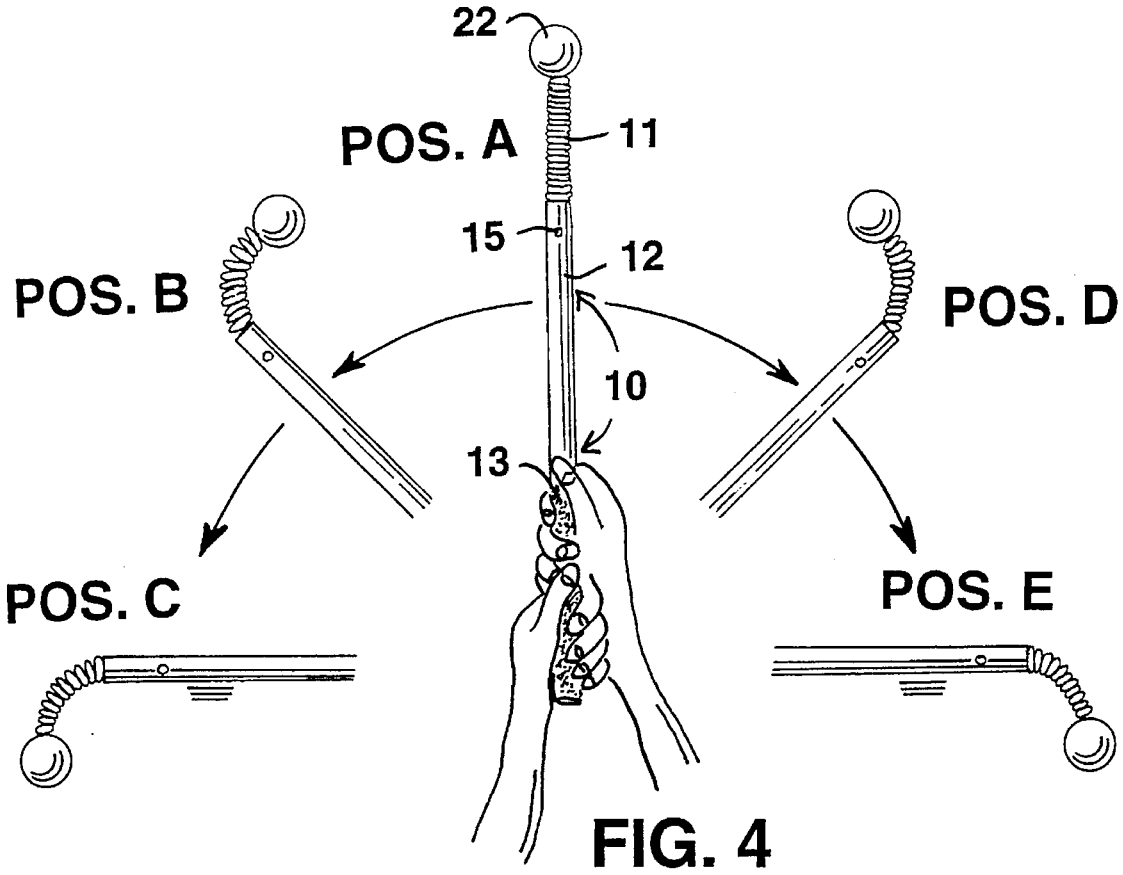

FIG. 4, Pos. A to E, show a method by which the sports swing exercise device is swung with the hands and arms.

REFERENCE NUMERAL IN DRAWINGS 10 general configuration of the invention
11 spring
12 shaft
13 grip
14 spring/weight attaching pin
15 spring/shaft attaching pin
16 filling material
17 lower hooked end of spring
18 channel cut through weight
19 pin hole through weight
20 spring housed inside shaft
21 upper hooked end of spring
22 end weight

DESCRIPTION—FIGS. 1 TO 3B

Referring to FIG. 1 of the drawing, the present invention 10 consists of an end weight 22 connected to a shaft 12 by means of a spring 11, the shaft 12 being capped with a grip 13.

In FIG. 2 attachment of the spring 11 to the weight 22 is shown in cross-section by means of a pin 14 through the lower hooked spring end 17 set in filling material 16 in a channel cut through the top of the weight 18 at right angle to the pin hole 19. Further, in FIG. 2 the spring 11 is seen to reside inside the shaft 12 in cross-section and is attached to the shaft by means of a pin 15. At the top of the shaft 12 the grip 13 is shown in cross-section as it fits over the end of the shaft.

FIG. 3A shows in cross-section the attachment of the weight 22 to the spring 11 by means of a pin 14 inserted through the lower hooked spring end 17 in the channel 18 pushed through the pin hole 19 in the weight which is at right angles to the channel. FIG. 3B shows the spring 11 housed inside the shaft 20 and the attachment of the upper hooked spring end 21 by means of a pin 15 through the shaft 12.

OPERATION—FIG. 4, POS. A TO E

FIG. 4 shows how a person might swing the device 10 with the arms, wrists and hands as seen from a top view.

Pos. A shows the stationary position of the device 10 where a person places hands on the grip 13.

Pos. B and Pos. D show how the spring 11 bends in the opposite direction of the swing due to inertia on the weight 22.

Pos. C and Pos. E show how the spring 11 bends and the weight 22 is carried forward by momentum past the end of the shaft 12 after the swing has stopped, thus causing the stretching effect on the person's physiological musculature and articulation.

Specific ways to swing the device are as many as are the training desires of people using the device. The device can be swung through a full swing and allowed to stretch the muscles as for improving the full safe articulation range of the athlete. The device can be swung partially through a swing then stopped and swung in the reverse direction and back again many times to rapidly loosen and stretch muscles, ligaments, tendons that helps ready the muscles for athletic activity. By repeating the swinging motion many times, the muscle tissue used in the desired swing path of the athlete is strengthened.

SUMMARY, RAMIFICATIONS, AND SCOPE

Accordingly, the reader will see that the unique feature of the present invention 10 is the spring 11, attached on one end to the weight 22 and on the other end to the shaft 12. This unique combination of elements allows the athlete to warm up muscles quicker and safer than prior art without the feature of the spring 11. It is a device that can be used on or off the playing field to help an athlete to develop his or her muscular potential at that maneuver required by a specific sport.

While the above description contains many specifications, these should not be construed as limitations on the scope of the invention, but rather as an exemplification of one preferred embodiment thereof. For example, the weight 22 may be of many different sizes, weights, shapes and materials, as may the shafts 12, grip 13 and spring 11. Further, the means of attachment of the spring 11 to the shaft 12 and the weight 22 may be accomplished by many other methods than a straight pin, the channel in the weight 18 may assume many different shapes, depths and sizes, the filler material 16 may be epoxy, steel, or other material, and so forth. Accordingly, the scope of the invention 10 should be determined not by the embodiments illustrated, but the appended claims and their legal equivalents.

Having shown and described the present invention, what is claimed as new is as follows:

1. A golf swing muscle articulation device for use in minimizing the potential for muscle and skeletal injury at the top of the backswing and end of the follow-through, or for use in rehabilitating damaged or injured muscles or skeletal parts, such as the spine, caused by previous overexertion or improper application of the golf swing or related exercise devices, comprising in combination:

a standard hollow golf shaft with a standard golf grip attached thereto at the upper end;

a coiled spring fastened inside the lower end of the shaft at one end and inside a solid ball at the other end, whereby when the device is gripped with the hands at the upper end and swung in the typical arc of a golf swing, the coiled spring acts as a shock absorber at the top of the back swing and end of the follow-through, thereby easing the transition of momentum imposed by the movement of the ball at the ends of its arc, thus minimizing the potentially damaging effect of the momentum upon the muscles and spine.

2. The device of claim 1 whereby the spring:

is attached to the solid ball on one end by a pin inserted through a hole of slightly larger diameter of the pin, securing the curved open end of the spring within a channel cut or cast within the ball into which epoxy of other adhesive is added to make the end of the spring, the pin and the ball a cohesive unit; and on the other end is secured within the lower end of the golf shaft by a pin or rivet, further secured by epoxy or other adhesive material such that when the device is swung as intended, the spring flexes according to its design allowing the momentum at the end of the swing arc to be embodied within the path of the ball, its transition softened by the spring at the ends of the arc where the direction of the momentum reverses (back swing) or ceases (follow-through).

* * * * *